US007559800B2

(12) United States Patent
Wu

(10) Patent No.: US 7,559,800 B2
(45) Date of Patent: Jul. 14, 2009

(54) ELECTRONIC MODULE WITH ANTI-EMI METAL GASKET

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/080,326

(22) Filed: Apr. 1, 2008

(65) Prior Publication Data

US 2009/0156058 A1 Jun. 18, 2009

Related U.S. Application Data

(63) Continuation-in-part of application No. 11/999,403, filed on Dec. 5, 2007.

(51) Int. Cl.
*H01R 13/648* (2006.01)

(52) U.S. Cl. ..... 439/607; 439/939

(58) Field of Classification Search ..... 439/607, 439/609, 939; 174/354, 355
See application file for complete search history.

(56) References Cited

U.S. PATENT DOCUMENTS 6,095,862 A * 8/2000 Doye et al. ..... 439/607
6,135,793 A * 10/2000 Babineau ..... 439/92
6,206,730 B1 * 3/2001 Avery et al. ..... 439/609
6,206,731 B1 * 3/2001 Kuo ..... 439/610
6,213,812 B1 * 4/2001 Kan ..... 439/607
6,304,436 B1 * 10/2001 Branch et al. ..... 361/683
6,459,517 B1 * 10/2002 Duncan et al. ..... 398/135
6,461,058 B1 * 10/2002 Birch et al. ..... 385/92
6,478,622 B1 * 11/2002 Hwang ..... 439/607
6,485,322 B1 * 11/2002 Branch et al. ..... 439/357
6,524,134 B2 * 2/2003 Flickinger et al. ..... 439/607
6,607,308 B2 * 8/2003 Dair et al. ..... 385/92
6,634,803 B2 * 10/2003 Brezina et al. ..... 385/92
6,659,655 B2 * 12/2003 Dair et al. ..... 385/92
6,661,565 B2 * 12/2003 Shaw et al. ..... 359/297
6,705,879 B2 * 3/2004 Engel et al. ..... 439/76.1
6,752,663 B2 * 6/2004 Bright et al. ..... 439/607
6,758,699 B1 7/2004 Huang et al.
6,816,376 B2 * 11/2004 Bright et al. ..... 361/704
6,824,315 B2 * 11/2004 Irie ..... 385/92
6,874,953 B2 * 4/2005 Dair et al. ..... 385/92
6,875,056 B1 * 4/2005 Bianchini et al. ..... 439/608
6,893,293 B2 * 5/2005 Ice et al. ..... 439/607
6,980,437 B2 * 12/2005 Bright ..... 361/704
7,001,217 B2 * 2/2006 Bright et al. ..... 439/609
7,111,994 B2 * 9/2006 Schwiebert et al. ..... 385/92
7,150,653 B1 * 12/2006 Mason ..... 439/609
7,195,404 B1 * 3/2007 Dudley ..... 385/92
7,207,730 B2 * 4/2007 Huang et al. ..... 385/92
7,211,739 B1 * 5/2007 Brigham et al. ..... 174/359
7,219,404 B2 * 5/2007 Haga et al. ..... 24/458
7,258,574 B2 * 8/2007 Barringer et al. ..... 439/607
7,357,675 B2 * 4/2008 Barringer et al. ..... 439/609
7,413,473 B2 * 8/2008 Wu ..... 439/557

(Continued)

*Primary Examiner*—Ross N Gushi
(74) *Attorney, Agent, or Firm*—Wei Te Chung

(57) ABSTRACT

An electronic module (10) includes a housing having an outer surface; a metal gasket (5) has a frame portion (51), with a number of detents (52) formed thereon, said metal gasket (5) being attached to the housing and substantially covering the outer surface. The gasket (5) has at least one inclined stub portion (53*b*) formed on front edge of the frame portion (51) and inserted into a cavity (2130*a*) in the outer surface of the housing.

18 Claims, 5 Drawing Sheets

U.S. PATENT DOCUMENTS 7,422,481 B2 * 9/2008 Togami et al. ..... 439/607
7,438,564 B2 * 10/2008 Lloyd ..... 439/92
7,438,596 B2 * 10/2008 Phillips ..... 439/607
2002/0110338 A1 * 8/2002 Dair et al. ..... 385/92
2002/0131122 A1 * 9/2002 Anderl et al. ..... 359/152
2003/0021552 A1 * 1/2003 Mitchell ..... 385/92
2003/0138222 A1 * 7/2003 Irie ..... 385/92
2003/0171016 A1 * 9/2003 Bright et al. ..... 439/160
2003/0171033 A1 * 9/2003 Bright et al. ..... 439/607
2004/0037517 A1 * 2/2004 Dair et al. ..... 385/92
2007/0117458 A1 5/2007 Winker et al.
2007/0258682 A1 * 11/2007 Bright et al. ..... 385/55

* cited by examiner

ELECTRONIC MODULE WITH ANTI-EMI METAL GASKET

CROSS-REFERENCE TO RELATED APPLICATION

This application is a continuation-in-part (CIP) of U.S. patent application Ser. No. 11/999,403, filed on Dec. 5, 2007 and entitled "ELECTRONIC MODULE WITH SEAMLESS ANTI-EMI DEVICE", and it has the same applicant and assignee as the present invention. The disclosure of the related application is incorporated herein by reference.

BACKGROUND OF THE INVENTION

1. Field of the Invention

The present invention generally relates to an electronic module, and more particularly to an electronic module having a metal gasket for suppressing Electro-Magnetic Interference (EMI).

2. Description of Related Art

A small form factor pluggable (SFP) module is widely used because it is adapted for higher speed signal transmission. However, increasing data rates in the module result in the generation of higher-frequency electromagnetic interference (EMI) radiation. Since the higher-frequency EMI has shorter wavelengths, shielding against such EMI becomes increasingly difficult. U.S. Pat. Pub. No. 20070117458 A1 discloses a type anti-EMI transceiver module (electronic module) comprising transceiver frame, a circuit board assembly, a transceiver housing (metal shell), a transceiver collar with a plurality of detents thereof. The transceiver collar is first assembled to the transceiver frame, and then is sandwiched between the transceiver frame and the transceiver housing.

The aforementioned transceiver module (electronic module) may further preventing certain problem such as detents of the transceiver collar locking with cage of the complementary connector, and mate with the complementary connector freely, for a front segment transceiver collar is received in the transceiver housing. However, structure of the aforementioned transceiver module is relative complex and difficult in manufacturing.

Hence, an improved electronic module is highly desired to overcome the disadvantages of the related art.

SUMMARY OF THE INVENTION

Accordingly, an object of the present invention is to provide an electronic module having lead-in feature metal gasket.

In order to achieve the object set forth, an electronic module comprising: a housing having a longitudinal body portion and a mounting portion extending rearward from back edge of the body portion; a metal gasket has a frame portion, with a number of detents formed thereon, said metal gasket being attached to a rear segment of a peripheral surface of the body portion and adjacent to the mounting portion; and wherein the gasket has at least one inclined stub portion formed on front edge of the frame portion and inserted into a cavity in the peripheral surface of the body portion.

Other objects, advantages and novel features of the invention will become more apparent from the following detailed description when taken in conjunction with the accompanying drawings.

DETAILED DESCRIPTION OF THE INVENTION

Figure 1:
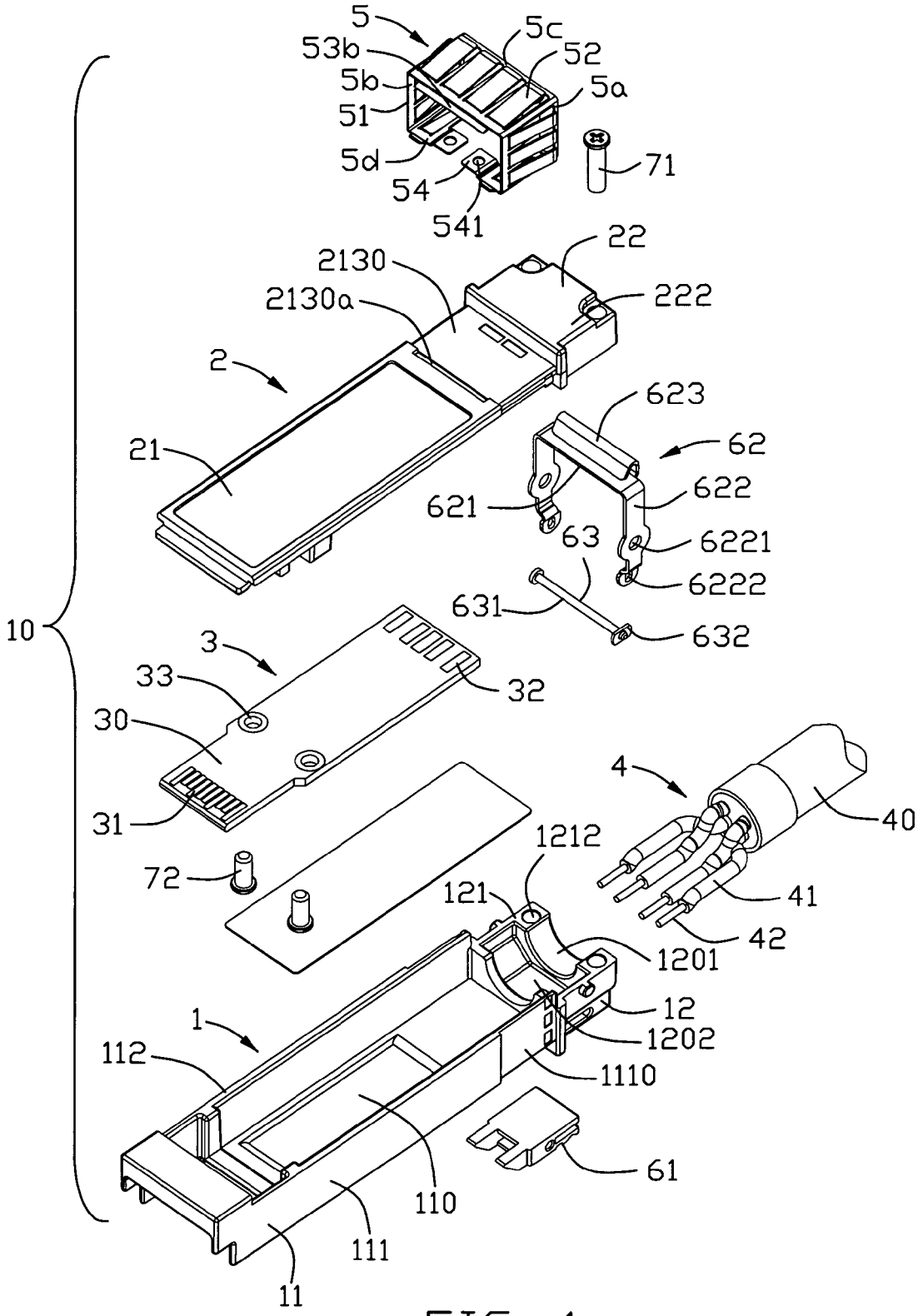
FIG. 1 is an exploded, perspective view of an electronic module in accordance with the present invention.

Reference will now be made in detail to the preferred embodiment of the present invention.

Referring to FIGS. 1-5, the electronic module 10 comprises a housing (not numbered) composed of a conductive base portion 1 and a conductive panel portion 2, a printed circuit board 3, a cable 4, a metal gasket 5 and an actuator mechanism (not numbered). The housing has a longitudinal body portion (not numbered) and a mounting portion (not numbered) extending rearward from the body portion. The metal gasket 5 is attached to a rear segment of a peripheral surface of the body portion and adjacent to the mounting portion.

Figure 2:
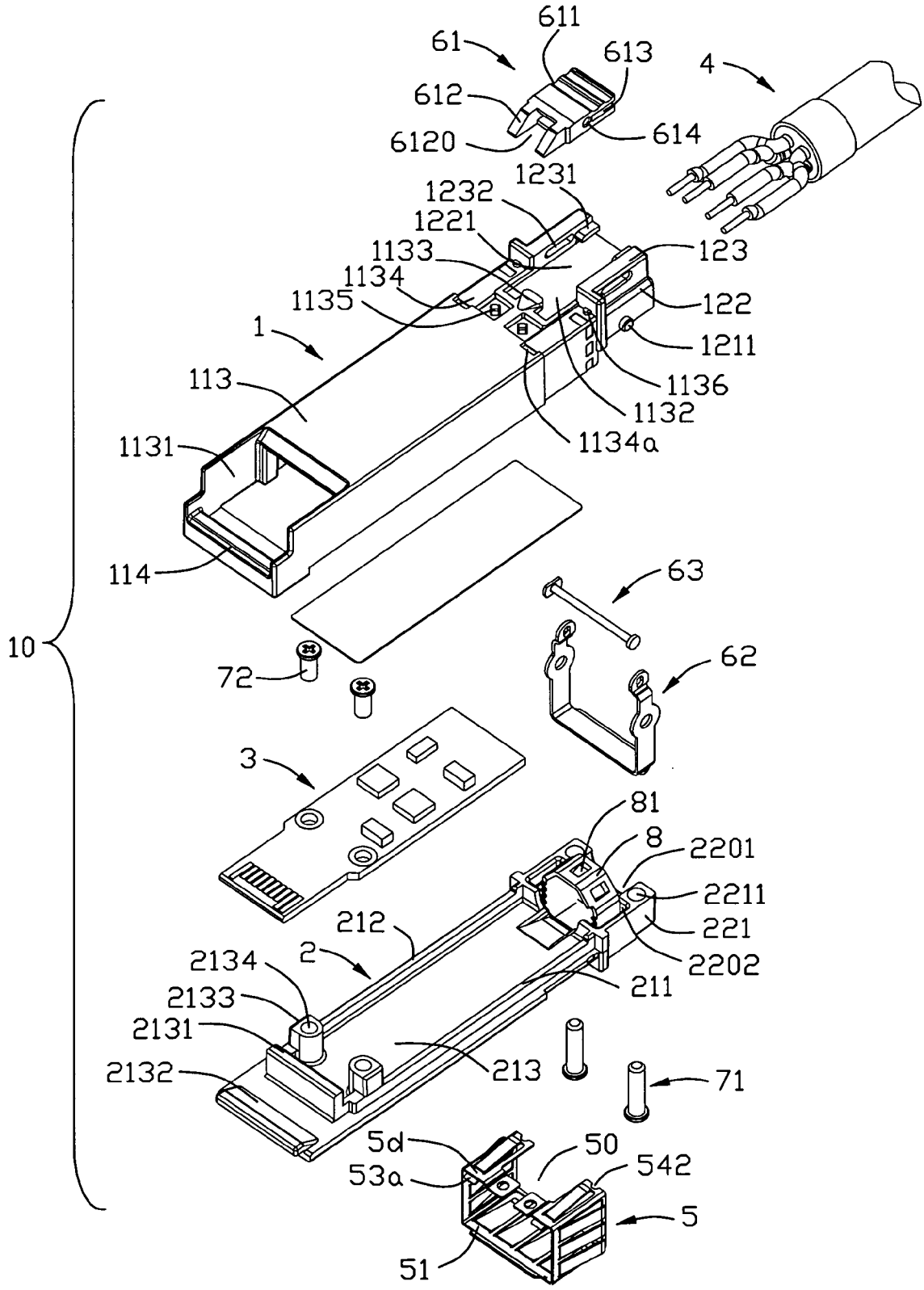
FIG. 2 is a view similar to FIG. 1, but viewed from another aspect.

Referring to FIGS. 1-2, the base portion 1 is die-cast or other metal plated body, including a primary body portion 11 and a first mounting portion 12 rearward extending from back face of the primary body portion 11. The primary body portion 11 has a pair of lateral walls 111, 112 and a bottom wall 113 joining to lower sections of the lateral walls 111, 112 to from a receiving space 110 with an upper window (not numbered). Rear sections of the pair of the lateral walls 11, 12 define a pair of first depression portions 1110. A front section of the bottom wall 113 is cut to form an outlet 1131. A rear section of the bottom wall defines a first channel 1132 located in a middle area thereof, with a tab 1133 formed in the front and middle of the first channel 1132. A pair of L-shaped depression portions 1134 are defined in two lateral areas of the rear section of the bottom wall 113, arranged at outward of the first channel 1132. A pair of tiny posts 1135 are respectively formed in forward corners (not numbered) of the pair of L-shaped depression portions 1134. A pair of narrow first cavities 1134*a* are respectively defined in front section of the L-shaped depression portions 1134, adjacent to the pair of the tiny posts 1135, and a pair of protrusion members 1136 respectively formed in a rear corners (not numbered) thereof, opposite to the pair of narrow cavities 1134*a*. The primary body portion 11 further has beam portion 114 with substantially L-shaped cross-section interconnecting distal portions of the pair of the lateral walls 111.

The first mounting portion 12 has a pair of side walls 121 and a lower wall 122 to corporately form a first semi-circular cavity 1201 and a deeper first position slot 1202 located in front of the first semi-circular cavity 1201. A second channel 1221 is defined in a middle area of the lower wall 122 and communicates with the first channel 1132 of the primary body portion 11. A pair of guiding members 123 are respectively formed on lateral areas of the lower wall 122. Each guiding member 123 has a thin bar member 1231 formed on a back section of the inward surface thereof and a lengthways guiding passage 1232 in front of the bar member 1231. A pair of pivot members 1211 are respectively formed on upper sections of the outward surfaces of the pair of side walls 121. A pair of screw holes 1212 are respectively recessed downward from up surfaces of rear sections of side walls 121.

The panel portion 2 is die-cast or metal plated body, including a secondary body portion 21 and a second mounting portion 22 rearward extending from back face of the secondary body portion 21. The secondary body portion 21 has a planar board member 213 and a pair of flange members 211, 212 formed on a bottom surface thereof laterally. An upper section of the board member 213 defines a second depression portion 2130. A narrow second cavity 2130*a* is respectively defined in front section of the second depression portions 2130. A front section of the board member 213 forms a vertical wall 2131. A pair of supporting posts 2133 are located back of the vertical wall 2131, and each supporting post 2133 further defines a second screw hole 2134 therein. A protrusion portion 2132 is formed at forward end of the board member 213.

The panel portion 2 further includes a second mounting portion 22 rearward extending from a back face of the secondary body portion 21. The second mounting portion 22 also has a pair of side walls 221 and a lower wall 222 to corporately form a second semi-circular cavity 2201 and a deeper second position slot 2202, located in front of the second semi-circular cavity 2201. A pair of through holes 2211 are respectively defined in a rear section of the side walls 221.

The actuator mechanism includes a slider member 61, an actuator member 62 and a fasten member 63. The slider member 61 has a substantially rectangular shaped body portion 611 and two wedge-shaped arm portions 612 extending forward from front face of the body portion 611. The two arm portions 612 space from one another, with an opening 6120 formed therebetween. The body portion 611 has two grooves 613 respectively recessed inward from lateral surfaces of a rear segment thereof and a transverse through hole 614 in a middle section thereof, adjacent to the grooves 613. The actuator member 62 is configured to doorframe-shaped, including a doorhead 621 and two door jambs 622. A curved handle member 623 is formed at rear edge of the doorhead 621 and protruding upwardly. A pair of first positioning holes 6221 are defined in a middle section of the door jambs 622, and a pair of mounting holes 6222 is defined through the lower ends thereof. The fasten member 63 is of rod-shaped, including a bolt member 631 and a nut 632.

Referring to FIGS. 1-2 and 5-6, the gasket 5 is made of sheet metal and configured to rectangular-shaped frame portion 51, including a pair of vertical sides 5*a*, 5*b*, an upper side 5*c* joining upper edges of the pair of vertical sides 5*a*, 5*b*, a pair of lower sub-sides 5*d* respectively extending inwardly from lower edges of the pair of vertical walls 5*a*, 5*b*. A lower outlet 50 formed between the pair of lower sub-sides 5*d* for assembling easily. A number of spaced detents 52 are stamped of the frame portion 51 and outward deflect the frame portion 51. A pair of mounting members 54 are formed on free ends of the pair of lower sub-sides 5*d*, extend into the lower outlet 50. A pair of first inclined stub portions 53*a* extend forward and upward from front edges of the pair of lower sub-sides 5*d* respectively and a second inclined stub portion 53*b* extends forward and downward from a front edge of the upper side 5*c*. Each sub-sides 5*d* has a semi-circular cutout 542 located in a distal end thereof to accommodate corresponding protrusion members 1136 in the L-shaped depression portion 1134.

The printed circuit board 3 includes a substrate 30, a plurality of first conductive pads 31 arranged on a front section of the substrate 30 and a plurality of second conductive pads 32 located on rear section thereof. A pair of positioning holes 33 are defined in the substrate 30, proximate a front section thereof.

The cable 4 includes an outer insulative jacket 40, a number of wires 41 enclosed in the jacket 40 and insulated from each other. Each of the wires 41 further has an inner conductor 42 for transmitting signal.

Figure 3:
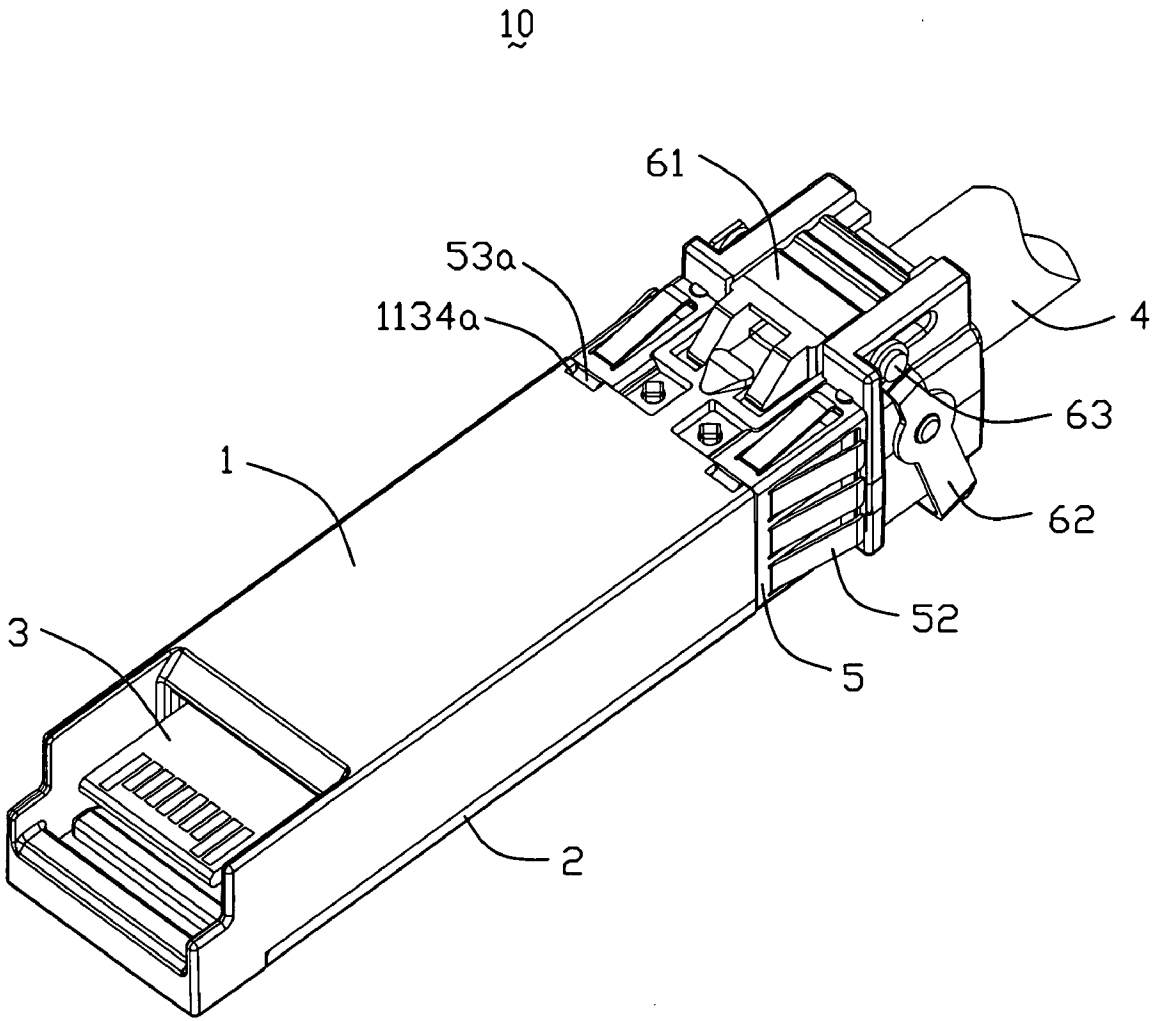
FIG. 3 is an assembled, perspective view of the electronic module shown in FIG. 2.
Figure 4:
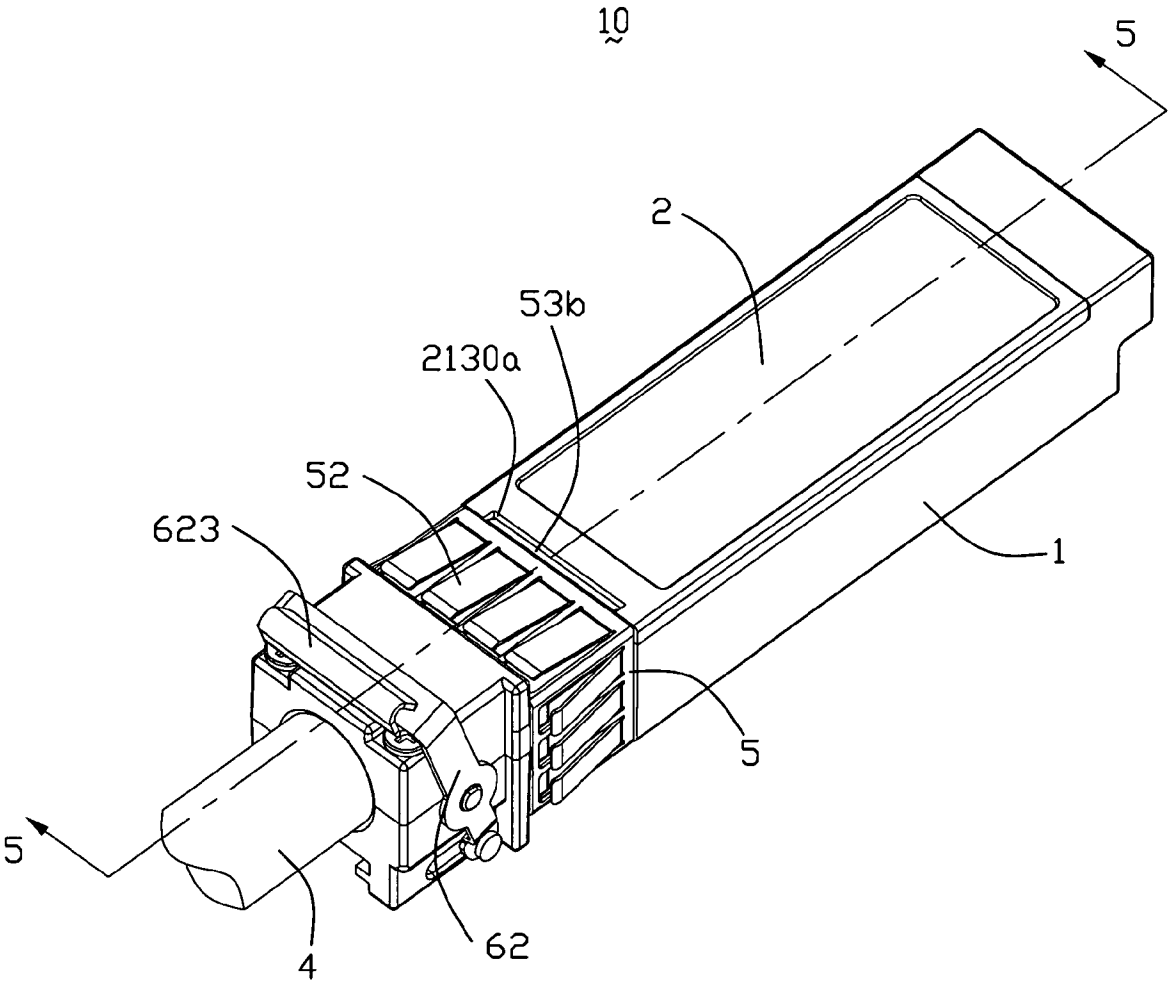
FIG. 4 is a view similar to FIG. 3, but viewed from another aspect.
Figure 5:
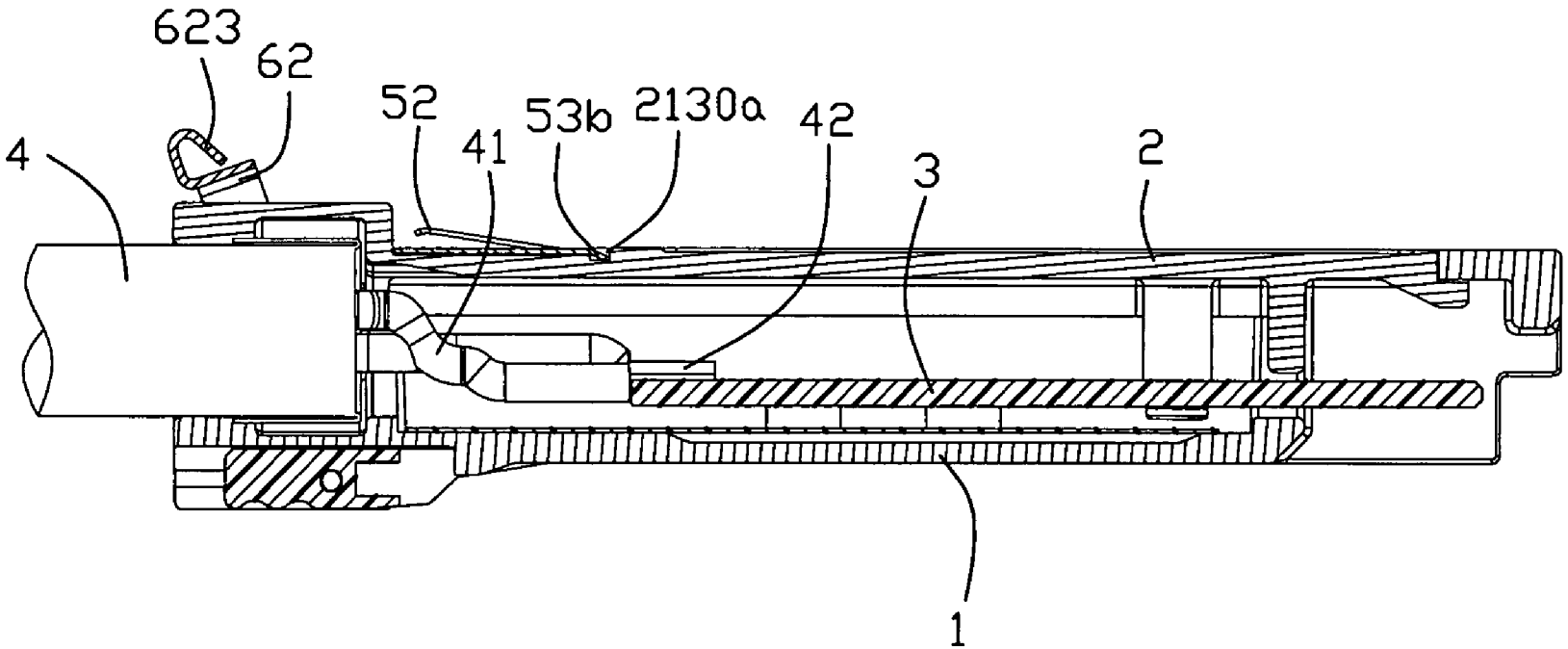
FIG. 5 is a cross-section view taken along line 5-5 of FIG. 4.

Referring to FIGS. 3-4, in conjunction with FIGS. 1-2 and 5-6, When assembly, the insulative jacket 40 of a front segment of the cable 4 is decorticated and then the wires 41 are exposed outside, and then front section of the inner conductors 42 are made to expose outward; then a cable holder member 8 is crimped to a front part of the cable 4, adjacent to exposed wires 41, with teeth 81 thereof biting into the insulative jacket 40. The inner conductors 42 are soldered to the second conductive pads 32 of the PCB 3. The PCB 3 is put on the pair of supporting posts 2133 of the panel portion 2, with the pair of positioning holes 33 thereof aligning with the pair of second screw holes 2134 of the pair of supporting posts 2133, and then a pair of second screw members 72 are inserted into the pair of positioning holes 33 and the pair of second screw holes 2134 to fix the PCB 3 to the panel portion 2. Partial of the cable holder member 8 is pressed into the second position slot 2202 of the panel portion 2. The panel portion 2 is assembled to the base portion 1, with a pair of lateral flange members 211, 212 thereof inserted into the receiving space 110, the protrusion portion 2132 supported by the beam portion 114 of the base portion 1, Simultaneously, the PCB 3 is received in the receiving space 110, a remaining portion of the cable holder 8 is received in the first position slot 1202, the pair of through holes 2211 of the panel portion 2 aligning with a pair of screw holes 1212 of the base portion 1, then a pair of first screw members 71 are inserted into the through holes 2211 and screw holes 1212 to fasten the panel portion 2 and the base portion 1 together.

The gasket 5 is assembled to an outer surface of the housing, with a pair of vertical sides 5*a*, 5*b* thereof located in the a pair of first depression portions 1110 of the base portion 1, an upper side 5*c* thereof located in the second depression portions 2130 of the panel portion 2, a pair of lower sub-sides 5*d* located in the pair of L-shaped depression portions 1134, the pair of tiny posts 1135 inserted into a pair of through holes 541 of the pair of mounting members 54 and then soldered thereto. Simultaneously, the pair of first inclined stub portions 53*a* and the second inclined stub portion 53*b* are respectively inserted into the pair of narrow first cavities 1134*a* in front section of the L-shaped depression portions 1134 and the second cavity 2130*a* in front section of the second depression portions 2130. The slider member 61 is assembled to the second channel 1221 of the first mounting portion 12, with the pair of thin bar members 1231 of the two guiding members 123 received in the two grooves 613 thereof, the through hole 614 thereof aligning with guiding passages 1232 of the two guiding members 123, the opening 6120 between the arm portions 612 facing to the tab 1133 in the first channel 1132. Then, the actuator member 62 is assembled to the first mounting portion 12 of the base portion 12, with the pair of pivot members 1211 of the first mounting portion received in the pair of first positioning holes 6221 of the doorjambs 622 of the actuator member 62, the pair of mounting holes 6222 located in the end section of the door jambs 622 aligning with the through hole 614 of the slider member 61 and the through holes 1232 of the two guiding members 123, then the a bolt member 631 is inserted through the pair of mounting holes

6222, the through holes 614, guiding passages 1232, and the nut 632 is finally assembled to end of the bolt member 631.

When the electronic module 10 mates with the complementary connector (not shown), via guiding of the first stub portions 53*a* and the second stub portion 53*b*, the gasket 5 may inserted into the cage of the complementary connector easily. Further more, the first stub portions 53*a* and the second stub portion 53*b* being inserted into the pair of narrow first cavities 1134*a* and the second cavity 2130*a*, such configuration may increase stiffness of the gasket 5 to prevent itself being arched.

While the electronic module 10 disengages away the complementary connector, just exert a pulling force on the handle member 623 of the actuator member 62 to promote the slider member 61 moving forwardly to reversely push the electronic module 10 moving backward to depart the complementary connector.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electronic module with seamless anti-EMI device, comprising:

a housing having a longitudinal body portion and a mounting portion extending rearward from back edge of the body portion;

a metal gasket has a frame portion, with a number of detents formed thereon, said metal gasket being attached to a rear segment of a peripheral surface of the body portion and adjacent to the mounting portion; and wherein the gasket has at least one inclined stub portion formed on front edge of the frame portion and inserted into a cavity in the peripheral surface of the body portion.

2. The electronic module as claimed in claim 1, wherein the housing includes a panel portion having a secondary body portion, with a rear segment thereof defining a depression portion and the cavity arranged in front of the depression portion, and wherein an upper side of the frame portion is mounted in the depression portion and the stub portion formed on the upper side of the frame portion is received in the cavity.

3. The electronic module as claimed in claim 1, wherein the housing includes a base portion having a primary body portion, with a rear segment thereof defining two depression portions and two cavities in front of the depression portions, and wherein two lower sides of the frame portion are mounted in the depression portions and two stub portions formed on the lower walls of the frame portion are received in the two cavities respectively.

4. The electronic module as claimed in claim 3, wherein the primary body portion of the base portion includes a pair of lateral walls joining to a bottom wall corporately forming a receiving space.

5. The electronic module as claimed in claim 4, wherein rear segments of the pair of the lateral walls of the primary body portion define a pair first depression portions to receive a pair of vertical sides of the frame portion.

6. The electronic module as claimed in claim 4, wherein a printed circuit board is located in the receiving space of the base portion.

7. The electronic module as claimed in claim 1, wherein the housing includes a base portion and a panel portion, wherein the base portion has a primary body portion and a first mounting portion rearward extending from back face of the primary body portion, and wherein the panel portion has a secondary body portion and a second mounting portion rearward extending from back face of the secondary body portion.

8. The electronic module as claimed in claim 7, wherein the first mounting portion defines a first semi-circular cavity, wherein the second mounting portion defines a second semi-circular cavity, and wherein a cable is inserted into a receiving space of the base portion via the first and second cavities.

9. The electronic module as claimed in claim 8, wherein the first mounting portion defines a deeper first position slot in a front portion of the first semi-circular cavity, wherein the second mounting portion defines a deeper second position slot in a front portion of the second semi-circular cavity.

10. The electronic module as claimed in claim 9, wherein a cable holder member is crimped onto a front section of the cable and retained in the first and second positioning slots.

11. The electronic module as claimed in claim 1, further comprising an actuate mechanism.

12. The electronic module as claimed in claim 11, wherein the actuator mechanism includes a slider member located in a channel of rear section of the base portion, an actuator member pivotally engaged with the base portion and a fasten member linkaged the slider member and the actuator member.

13. The electronic module as claimed in claim 12, further comprises a pair of guiding members respectively formed on rear section of the base portion, laterally arranged the channel of the base portion.

14. The electronic module as claimed in claim 13, wherein each of guiding member has a bar member formed on a back section of the inward surface thereof and a lengthways guiding passage in front of the bar member.

15. The electronic module as claimed in claim 14, wherein the slider member includes a body portion having two grooves respectively recessed inward from lateral surfaces of a rear segment thereof and a transverse through hole in a middle section thereof, in front of the grooves.

16. The electronic module as claimed in claim 15, wherein the actuator member is configured to doorframe-shaped, including a doorhead with handle member formed thereon and two door jambs having a pair of mounting holes defined through the lower ends thereof.

17. The electronic module as claimed in claim 16, wherein the bar members of the pair of guiding member are received in the two grooves of the base portion of the slider member respectively, wherein the mounting holds of the actuator aligns with the guiding passages of the pair of the guiding members and the transverse through hole of the slider member to allow the fasten member pass through.

18. An electronic module with seamless anti-EMI device, comprising:

a housing having a longitudinal body portion and a mounting portion extending rearward from back edge of the body portion;

a metal gasket has a frame portion, with a number of detents formed thereon, said metal gasket being attached to a rear segment of a peripheral surface of the body portion and adjacent to the mounting portion;

wherein the gasket defines at least one hole receiving a post formed on the peripheral surface of the body portion.

* * * * *